United States Patent [19]

Washino et al.

[11] Patent Number: 4,862,851

[45] Date of Patent: Sep. 5, 1989

[54] IDLING ENGINE SPEED CONTROLLING APPARATUS

[75] Inventors: Shoichi Washino; Yukinobu Nishimura, both of Amagasaki, Japan

[73] Assignee: Mitsubishi Denki Kabushiki Kaisha, Tokyo, Japan

[21] Appl. No.: 183,133

[22] Filed: Apr. 19, 1988

[30] Foreign Application Priority Data

| | | | |
|---|---|---|---|
| Apr. 20, 1987 | [JP] | Japan | 62-96662 |
| Nov. 19, 1987 | [JP] | Japan | 62-293528 |
| Feb. 18, 1988 | [JP] | Japan | 63-36360 |

[51] Int. Cl.[4] ..... F02M 3/06

[52] U.S. Cl. ..... 123/339

[58] Field of Search ..... 123/339, 340, 585, 588

[56] References Cited

U.S. PATENT DOCUMENTS

| | | | |
|---|---|---|---|
| 4,716,871 | 1/1988 | Sakamoto et al. | 123/339 |
| 4,721,082 | 1/1988 | Hibibo et al. | 123/339 |
| 4,721,083 | 1/1988 | Hosaka | 123/339 |
| 4,724,810 | 2/1988 | Poirier et al. | 123/339 |
| 4,732,125 | 3/1988 | Takizawa | 123/339 |
| 4,742,807 | 5/1988 | Sakamoto et al. | 123/339 |
| 4,748,951 | 6/1988 | Manaka et al. | 123/339 |

*Primary Examiner*—R. A. Nelli

*Attorney, Agent, or Firm*—Oblon, Spivak, McClelland, Maier & Neustadt

[57] ABSTRACT

An idling engine speed controlling apparatus has a feedback control system to regulate engine speed to a target speed such that a torque disturbance is directly detected to convert it into a signal so that an air-flow rate or ignition timing is controlled on the basis of the sum of the signal and a time-differential of the signal, or such that sub-feed-back compensation is given to the output end of a proportional and integral controller so that an amount of air flowing in an intake air conduit is compensated with the first-order-lag component or an amount of air is controlled in response to the first-order-lag component or the second-order-lag component or the sum of or the difference between these components, or such that an output from the proportional and integral controller or an output from the actuator is fed back to the input side of the controller so as to include a transfer function of the actuator through a detection circuit.

16 Claims, 12 Drawing Sheets

NYQUIST DIAGRAM (I CONTROL)
(Ln = 0.5, K = 0)
Ln = L/T Tn = Ti/T

IDLING ENGINE SPEED CONTROLLING APPARATUS

SUMMARY AND FIELD OF INVENTION

The present invention relates to an idling engine speed controlling apparatus for an internal combustion engine. More particulary, it relates to improvement in stability and response of the control of engine speed.

In recent years, various auxiliary devices are mounted on an automobile owing to various demands. Of the auxiliary devices, there are ones of a type driven by the engine. Some devices has a load as large as to change the revolution of the engine, particulary in idling operations, when they are actuated.

For instance, an air-conditioner, a power steering system, a defogger (which particulary consumes a large current) and so on sometimes invite increase in the load torque of the alternator, when they are actuated, to thereby cause engine stop.

A conventional engine speed controlling system for an automobile with auxiliary devices having a large load will be described with reference to drawings.

FIG. 13 is a block diagram of a conventional engine speed controlling apparatus. In FIG. 13, a reference numeral 1 designates a setting circuit to produce a set signal of voltage in response to a predetermined target revolution number. The set signal is supplied to a subtractor which also receives a detection signal from an engine speed detecting circuit 5, the detection signal indicating a voltage in response to an actual revolution of the engine. The subtractor 11 compares the set signal with the detection signal to output an error signal to a proportional and integral controller 2. The proportional and integral controller 2 comprises a circuit for amplifying an error signal and an integrating circuit for integrating an error signal, the circuits being connected in parallel to each other. An actuator 3 adjusts ignition timing of the engine 4 or a flow rate of intake air depending on the output voltage of the proportional and integral controller 2.

FIG. 14 is a block diagram showing an engine speed control system when the transfer functions of the elements from the input terminal of the actuator 3 through the engine 4 to the output terminal of the engine speed detection circuit 5 are gathered into a signal transfer function 345.

The operation of the conventional engine speed control system will be described with reference to FIG. 13.

Assuming that the setting circuit 1 outputs a target voltage signal corresponding to a target engine speed (generally, it shows 800–900 rpm when the load of an air-conditioner is inserted in idling operation of the engine even though the engine speed varies depending on the function of the engine). The target voltage signal is inputted in the subtractor 11. The subtractor 11 produces an error signal obtained by subtracting the target signal from a voltage signal which corresponds to the actual engine speed. The error signal is outputted from the engine speed detection circuit 5. The error signal is subjected to proportional amplification and integral amplification by a proportional and integral controller 2 so that thus obtained voltage signal is supplied to the actuator 3 as manipulated variable.

The actuator 3 controls ignition timing or an air-flow rate of intake air to the engine on the basis of the voltage signal. The engine 4 produces an actual engine speed corresponding to the ignition timing or the air-flow rate determined by the actuator 3. The engine speed detection circuit 5 generates a voltage signal corresponding to the actual engine speed, and the voltage signal is fed back to the subtractor 11. Thus, in such feed-back control system, control is so made as to make the error signal to be zero under steady condition. In this case, the both voltage signals, one corresponding to the target engine speed and the other corresponding to the actual engine speed, become equal to each other, so that the actual engine speed is in coinsidence with the target engine speed, i.e. the actual engine speed is controlled to be always equal to the target engine speed under steady condition.

The operation of the engine under transient condition will be described.

Explanation will be made as to the case that a load such as an air-conditioner is suddenly inserted in the idling operation of the engine, as a typical example under the transient condition.

In the control system shown in FIG. 13, assuming that a load is suddenly added to the engine to thereby cause sudden decrease of the engine speed. Then, the level of a voltage signal outputted from the engine speed detection circuit 5 is reduced, with the result that an error signal becomes a positive voltage signal. After the signal is treated in the proportional and integral controller 2, the actuator 3 is actuated so that the control system operates to increase the revolution of the engine 4, and the engine speed is restored to have a predetermined engine speed. In the course of controlling the engine speed, it is desirable that a proportional gain and an integral gain in the porportional and integral controller 2 sould be large and a voltage signal producing a large manipulated variable for an error signal should be supplied to the actuator 3 in order that the actual engine speed is rapidly returned to the target engine speed as possible. Namely, the reduced actual engine speed owing to sudden insertion of a load is rapidly returned to the target speed by increasing the sensitivity of the conrol system.

Thus, to increase the sensitivity of the control system by increasing the proportional gain and the integral gain in the proportional and integral controller is very important factors from the following viewpoints:

(1) Influence by an outer disturbance should be promptly removed, and (2) expected performance of control should be obtained regardless of change or dispersion in characteristics of the controlled system. However, it is very difficult to increase the sensitivity of the control system for controlling engine speed at present. The reason is as follows.

As an example, a case that an air-flow rate of intake air is controlled by the actuator 3 will be described.

In the transfer characteristics from response to the intake air-flow rate to response to the engine speed, there are a second-order-lag component which causes a phase lag of 180° and a dead time component due to delay of movements. Accordingly, when the sensitivity of the control system is increased, i.e. a high gain is to be obtained, the control system becomes unstable and a hunting phenomenon may occur.

The above-mentioned problem will be described more in detail by using formulas and with reference to FIG. 14.

In FIG. 14, when the transfer function of the proportional and integral controller 2 and the transfer function 345 are respectively determined to be Gc(S) and $G_{345}$ (S) $e^{-SL}$, and when the voltage signal of the setting circuit 1 is to be r and the output (voltage signal) of the transfer function 345 is to be y, the closed loop transfer function y/r from the signal r to the output y is given by the following formula.

$$\frac{y}{r} = \frac{Gc(S)G_{345}(S)e^{-SL}}{1 + Gc(S)G_{345}(S)e^{-SL}} \quad (1)$$

Accordingly, the characteristic equation which determines stability of the control system is experssed by:

$$1+Gc(S)G_{345}(S)e^{-SL}=0 \quad (2)$$

As well known, analysis of the stability by using the equation (2) can be performed by drawing an Nyquist diagram.

The analysis of stability of the control system will be made by actually drawing the Nyquist diagram.

When a proportional gain is represented by K and an integral time (the reciprocal of an integral gain) is by Ti, Gc(S) is given by the following formula because it represents proportionl and integral characteristics:

$$Gc(S) = \frac{1 + SKTi}{STi} \quad (3)$$

On the other hand, the transfer function $G_{345}$ (S) for the actuator through the engine can be expressed by an approximation formula with a second-order-lag as follows:

$$G_{345}(S) + \frac{1}{(1 + ST)^2} \quad (4)$$

where T is a time constant. The time constant relies on engine speed, flywheel inertia moment, the capacity of surge tank and so on. Generally, when equilibrium engine speed No=750 rpm, the value is about 0.3 seconds. Further, when equilibrium engine speed No=750 rpm and four stroke movement is taken as dead time L, it is $4\times60/(2\times No)=0.16$ seconds.

The formulas (3) and (4) are changed as follows by substituting the formula $S=j\omega$:

$$\omega KTi=\omega T\times(Kti/T)$$

$$\omega Ti=\omega T\times(Ti/T)$$

$$\omega L=\omega T\times(L/T).$$

When a Nyquist diagram is drawn by using K and Ti as parameters, the representation as in FIG. 15 is obtainable. In FIG. 15, the solid line indicates a vector locus when K=0 and Ti/T=1. As is clear from the FIG. 15, when a frequency f=0.37 Hz, there is obtainable a phase difference of 180° and the absolute value of 0.96. This shows that the control system is at the stability limit, and it does not operate stably in practical operations. Similary, when a frequency which causes the control system to be unstable is obtained by Nyquist diagrams in which the parameters K, Ti are used, the frequency is within 0.37 Hz–0.7 Hz.

On the other hand, in accordance with our experiments, frequencies which cause an idling engine speed control system to be unstable, which may cause the hunting phenomenon, are plotted in a range from 0.3 Hz to 0.7 Hz. It is revealed that the above-mentioned analysis well coincides with the experiments. When the ranges of K and Ti which render the control system to be stable are obtained from the above-mentioned analysis, K=1 to 2 and Ti/T is 1 or higher, this being in coincidence with the experiments.

The above-mentioned fact suggests as follows:

(1) The control system becomes unstable unless the proportional gain K is at most 2 and the integral time Ti is greater than 0.3 seconds (accordingly, the integral gain is small) in the idling engine speed control system.

(2) For the unstable operations of the control system, it is impossible to increase the sensitivity of the control system (to have a high gain). Accordingly, response (following-up characteristic) to a disturbance becomes poor, and when a large load is suddenly applied to the engine, there may take place engine stop.

There is another cause to invite the engine stop due to the poor response (the following-up characteristic) in the currently used idling engine speed control system. Namely rational and effective measures to a load disturbance may not be sometimes established for the idling engine speed contral system although it is understood that the load disturbance to the engine changes the transfer characteristics of the engine as an object to be controlled.

This problem will be explained in detail with reference to FIG. 16.

In FIG. 16, Gc(S) represents a controller, Ge(S) represents the transfer function of a controlled system or a controlled object, $D_1$ and $D_2$ represent disturbances, R represents a target value, Y represents a controlled variable, and U represents a manipulated variable. In the same manner that the formula 1 is obtained, the following formulas are established:

$$\frac{Y}{R} = \frac{Gc(S)Ge(S)}{1 + Gc(S)Ge(S)} \quad (5)$$

$$\frac{Y}{D_1} = \frac{Ge(S)}{1 + Gc(S)Ge(S)} \quad (6)$$

$$\frac{Y}{D_2} = \frac{1}{1 + Gc(S)Ge(S)} \quad (7)$$

In the formulas (6) and (7), when the gain of the controller (Gc(S)) is large enough, $Y/D_1$ and $Y/D_2$ respectively become zero, and the controlled variable Y is not influenced by the disturbances $D_1$ and $D_2$. This shares one important reason to increase the above-mentioned sensitivity. Another important factor is that in the above equations, there is assumption that the transfer function Ge(S) of the controlled system is not changed by the disturbances $D_1$ and $D_2$. Namely, in usual design of feed-back control systems, the transfer function Ge(S) is so determined as to have a high gain as far as stability characteristics are not impaired on the basis of the assumption that the transfer function Ge(S) is not changed by the disturbances $D_1$, $D_2$, whereby influence by the disturbances is eliminated. For instance, the controller is so designed as to have a high gain on the basis of the closed loop transfer characteristics (the equation (6)) from the target value R to the controlled variable Y when the disturbances $D_1$ and $D_2$ are respectively zero. In this case, when the gain of the controller is high, $Y/D_1$ and $Y/D_2$ respectively become zero in the equations (6), (7). This implies that the controlled variable Y is not influenced by the disturbances $D_1$, $D_2$. However, such design is allowed only when there are assuarances that (1) the gain of the controller can be made high, and (2) the transfer function Ge(S) of the controlled system is not changed by the presence of the disturbances $D_1$, $D_2$.

In the idling engine speed control system, however, since the transfer function of the controlled system is changed by the disturbances as described below in addition that it is difficult to increase the gain of the controller as previously mentioned, the currently used idling engine speed control system undergoes a large influence of the disturbances. For instance, an engine speed is greatly reduced by a torque disturbance, and in the worst case, there occurs engine stop.

Various measures are taken to improve the above-mentioned problems. For instance, there is a proposal that a switching signal for a load such as an air-conditioner is inputted in a computer which detects operations of the air-conditioner before the load is applied to the engine, so that an actuator is driven. In this method, however, when there is a fair time lag between inputting of the switch signal and application of the load of the air-conditioner to the engine, the engine speed often suddenly decreases after it has once increased, whereby a driver may feel uneasy.

There is another proposal of improving the feed-back control system as shown in FIG. 17 which is published in Japanese Examined Patent Publication 43535/1986.

In FIG. 17, a reference numeral 6 designates a detection circuit for generating a detection signal representing a voltage corresponding to a rate of reduction of engine speed. The detection signal of the detection circuit 6 and the detection signal of the engine speed detection circuit 5 are summed in an adder 12, and thus obtained electric signal is outputted to the subtractor 11. The operation of the control system shown in FIG. 17 will be described.

In the same manner as described before, assuming that a load disturbance is suddenly applied to the engine to cause sudden reduction of the engine speed when the control system is in steady condition. In this case, there is obtainable the same function as in FIG. 13 for the setting circuit 1 through the engine speed detection circuit 5. However, in the control system as shown in FIG. 17, a voltage in proportion to a reduction rate of the engine speed is additionally fed back by the detection circuit 6, whereby an error signal produced is greater than that of the control system as shown in FIG. 13. Accordingly, the actual engine speed is quickly returned to the target speed in comparison with the control system as shown in FIG. 13.

Although the above-mentioned control system having a feed forward compensation at its part provides quick return of the engine speed to the target speed, such feed-forward compensation can be accomplished only in a very limited case (for instance, change of the characteristics of a controlled system is very small). Accordingly, expected effect can not be always obtained. For instance, when the target engine speed is 600 rpm, the system operates without troubles. However, when the target speed is 1000 rpm, it often causes adverse effect. Specifically, when a parameter for feed-forward compensation is determined with respect to a target engine speed (600 rpm), and if the target engine speed is greatly changed (e.g. 1000 rpm), there can not be obtained the feed-forward compensation, but rather it tends to promote fluctuation.

There is a proposal to control ignition timing by using the actuator 3 as shown in FIG. 13 (Japanese Examined Patent Publication No. 53544/1986). Generally, in controlling the engine speed, either the control of an intake-air flow rate or the control of the ignition timing is considered. Since a quick response is obtainable by using the control of ignition timing, an adverse effect by the reduction of the engine speed due to disturbances can be more or less removed by controlling the ignition timing. However, a cntrollable range of engine speed by controlling the ignition timing is limited.

Thus, in the conventional engine speed control apparatus as shown in FIGS. 13 and 17, although they have such advantage that the influence of the load disturbance to the engine is quickly removed to have the engine speed returned to the target speed, a great effect of returning to the target speed can not be expected since such apparatuses do not employ measures to improve the sensitivity of the control system by increasing the proportional gain and the integral gain of the proportional and integral controller 2.

It is an object of the present invention to provide an idling engine speed controlling apparatus for an internal combustion engine which is capable of improving the sensitivity of a control system and of controlling an air-flow rate, whereby influence by a load disturbance is quickly removed, and the idling engine speed is quickly returned to a target speed.

In accordance with the present invention, there is provided an idling engine speed controlling apparatus for an internal combustion engine comprising an intake air conduit formed to by-pass a throttle value, an actuator for controlling air flowing in the intake air conduit and a detecting means for detecting an idling speed of the engine to thereby control by feeding back the idling speed to be a predetermined value, the idling engine speed controlling apparatus being characterized by comprising means for detecting a torque disturbance to the engine to convert it into an electric signal depending on the magnitude of the disturbance, and a control means for controlling an air-flow rate or ignition timing in proportion to the sum of the electric signal and a time-differential component of the electric signal.

Further, in accordance with the present invention, there is provided an idling engine speed controlling apparatus for an internal combustion engine which comprises:

- an engine speed detecting circuit for detecting an idling speed of the engine,
- a setting circuit for outputting a set signal corresponding to a target speed on the engine,
- a proportional and integral controller for amplifying and integrating an error produced between a signal detected by the engine speed detecting circuit and the set signal,
- a feed-back control system which gives sub-feed-back compensation to the output end of the proportional and integral controller so that an amount of air flowing in an intake air conduit by-passing a throttle value is compensated with the first-order-lag component caused by the change of a state quantity which represents the condition of the engine, or which controls the amount of air in response to the first-order-lag component or the second-order-lag component caused by the change of an operational parameter of the engine, or the sum of or the difference between these elements, and an actuator for controlling an air-flow rate in the intake air conduit by the output of the proportional and integral controller to thereby coincide the idling speed with the target speed.

Further, in accordance with the present invention, there is provided an idling engine speed controlling apparatus which is so adapted to detect an engine speed by a detection circuit to output an error signal on the basis of the engine speed, to compare the error signal with a set signal in response to a target speed by means of a main feed-back loop to thereby output an error signal, to feed the error signal to a proportional and integral controller, and to drive an actuator by the output of the controller to cancel the error signal whereby the engine speed is controlled to be at the target speed, the idling engine speed controlling apparatus being characterized by comprising a sub-feed-back loop in which an output from the proportional and integral controller or an output from the actuator is fed back to the input side of the controller so as to include a transfer function of the actuator through the detection circuit.

DETAILED DESCRIPTION OF THE DRAWINGS

In the following, preferred embodiments of the present invention will be described with reference to the accompanying drawings.

Figure 1:
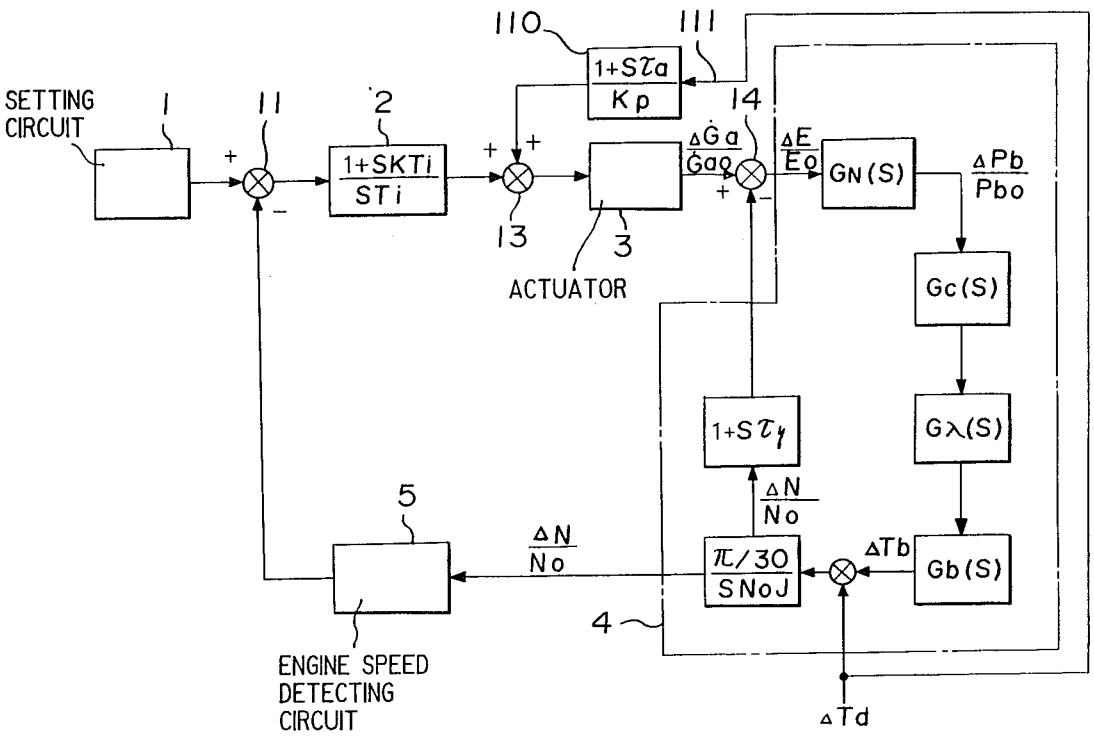
FIG. 1 is a block diagram showing the construction of an embodiment of the idling engine speed controlling apparatus according to the present invention.
Figure 3:
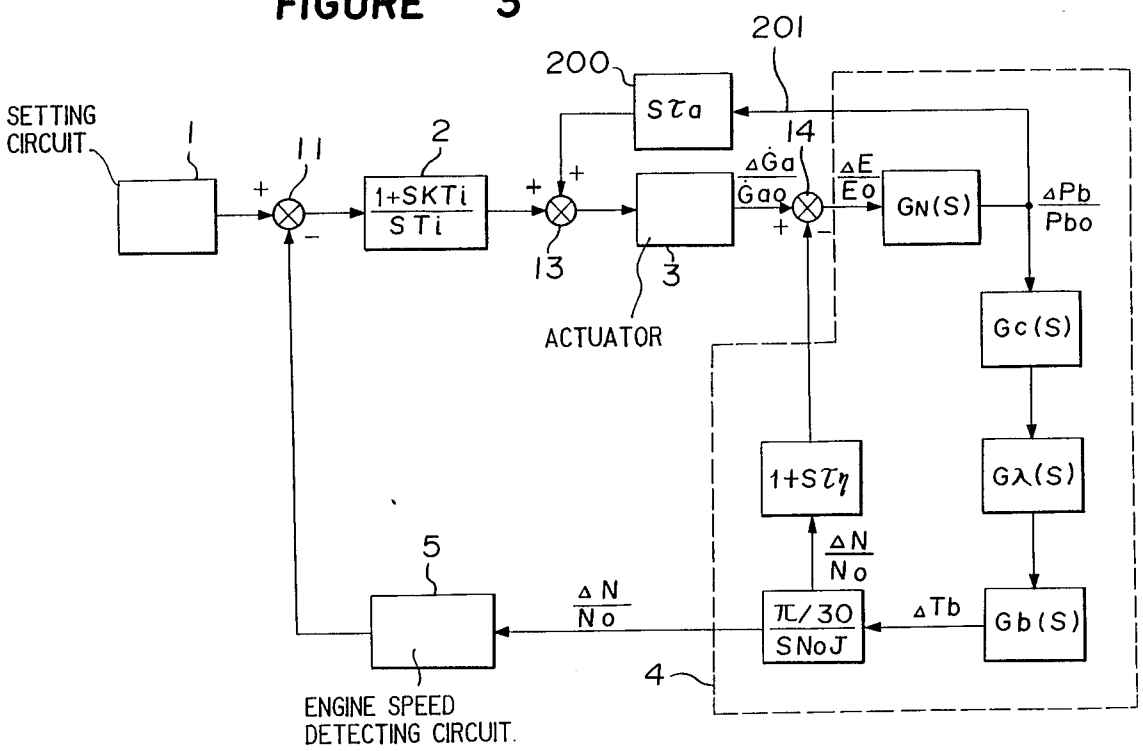
FIG. 3 is a block diagram showing the construction of a second embodiment of the idling engine speed controlling apparatus according to the present invention.

FIG. 1 is a block diagram showing the construction of a first embodiment of the engine speed controlling apparatus according to the present invention. In FIG. 1, the same reference numerals as in FIG. 13 designate the same or corresponding elements. A reference numeral 13 designates an adder, a numeral 14 designates a substractor, and a numeral 110 refer to the transfer function of a sub-feed-back control system 111. In FIG. 1, a bracket indicated by one-dotted line shows function of the conventional engine 4 as shown in FIG. 3, namely, it shows in a form of block diagram that a variation $\Delta Ga$ in air-flow rate is modified into a variation $\Delta Pb$ in intake-air-tube pressure, and then into a variation $\Delta N$ in engine speed.

In this embodiment of the present invention, the sub-feed-back control system 110 with a transfer function of $(1+S\tau a)/Kp$ is formed from an adder for a torque disturbance $\Delta Td$ to the adder 13, i.e. the side of an intake-air flow rate $\Delta\dot{G}a/\dot{G}Ao$ (hereinbelow, referred to as $\Delta\dot{G}a^*$). With such sub-feed-back system, the transfer function of the idling engine speed control system for the engine is not changed by disturbances, and fluctuation of the engine speed caused by the disturbances is quickly regulated.

The feature of the embodiment of the present invention will be more detailedly explained with reference to formulas. Transfer characteristic $G_N(S)$ from an error signal $\Delta E/Eo$ of a regulated air-flow rate to an intake-air pressure $\Delta Pb/Pbo$ (hereinbelow referred to as $\Delta Pb^*$) is given by the following formula with the first order lag (here, $\tau\eta=0$ in FIG. 1 for simplifying explanation):

$$G_N(S) = \frac{1}{1 + S\tau a} \tag{8}$$

In the above-mentioned formula, $\tau a$ is a time constant which is given by the following formula:

$$\tau a = \frac{120}{\eta voNo} \frac{Vm}{Vh} \tag{9}$$

Where $\eta vo$ is volmetric efficiency at an equilibrium time, No is engine speed at an equilibrium time, Vm is the capacity of an intake-air manifold from the throttle valve to the intake-air valve, and Vh is capacity of the displacement of the engine. Generally, $\tau a$ is about 0.27 seconds when No=750 rpm, $\eta vo=0.6$, and Vm=Vh.

The feed-back control for the engine speed before $G_n(S)$ is realized by a mechanical means which is so operated as to increase or decrease the intake-air pressure when the engine speed is decreased or increased in the idling state of the engine. Gc(S) is a transfer characteristic which is relied on air-metering method for the fuel control, wherein when the fuel is injected in proportion to the intake-air pressure, i.e. using a speed density device (D-Jetro manufactured by Bosch in West Germany), there is given "1" unless lag in controlling works is taken into consideration. On the other hand, when the fuel is injected in proportion to air-flow rate per number of revolution, which is obtained by measuring an amount of intake-air by using an air-flow meter, (i.e. using L-Jetro manufactured by Bosch in West Germany), there is given a formula of $1+S\tau a$. For simplyfication of explanation, lets Gc(S)=1 here. $G\lambda(S)$ represents fuel-supplying characteristic in the intake-air tube which relates the width $\Delta Pw/Pwo$ of the pulse of fuel injection with an air ratio $\Delta\lambda/\lambda o$. Again, for simplyfication of explanation, G (S) is considered to be equal to 1.

A transfer characteristic Gb(S), which relates an engine torque $\Delta Tb$ with $\Delta N/No$ (hereinbelow, referred to as $\Delta N^*$), $\Delta Pb/Pbo$ and $\Delta\lambda/\lambda o$, is given by the following formula:

$$\Delta Tb = Kn\frac{\Delta N}{No} + Kp\frac{\Delta Pb}{Pbo} + K\lambda\frac{\Delta\lambda}{\lambda o}$$

where Kn, Kp and $K\lambda$ are respectively constants which are experimentally determined at an equilibrium operating point (No, Pbo, $\lambda o$). Since the meaning of the constants in physics and methods of measuring them are described in, for instance, the Article 860411 (SAE Paper 860411) of the Society of Automotive Engineering, a simple explanation will be provided here. Namely, the constant Kn represents a change of net torque derived from the revolution speed $\Delta N/No$; the constant Kp represents a change of net torque derived from the intake-air pressure $\Delta Pb/Pbo$; and the constant $K\lambda$ represents a change of net torque derived form the air ratio $\Delta\lambda/\lambda o$. For simplifying of explanation, when assuming that there is no fluctuation in the air ratio and Kn is zero, the change of net torque $\Delta Tb$ depends only on the fluctuation of intake-air pressure $\Delta Pb^*(\Delta Pb/Pbo)$, and the magnitude of the change $\Delta Td$ is given by the following formula:

$$\Delta Tb = Kp\Delta Pb^* \quad (10)$$

The difference between an engine torque $\Delta Tb$ and a load disturbance $\Delta Td$ is converted again into an engine speed $\Delta N/No$ as represented by the well-known Euler's equation described blow:

$$\frac{\Delta N}{No} = \frac{\pi/30}{SNoJ}(\Delta Tb - \Delta Td) \quad (11)$$

where J is the moment of inertia of a flywheel. Finally, the relation among the intake-air flow rate $\Delta\dot{G}a/\dot{G}ao$, $\Delta E/Eo$ and the revolution speed $\Delta N/No$ is given by deffinition formulas of the law of conservation of mass, a state equation and volmetric efficiency. Namely, $$\frac{\Delta\dot{G}a}{GaO} - \frac{\Delta N}{No} = \frac{\Delta E}{Eo} = (1 + S\tau a)\frac{\Delta Pb}{Pbo} \quad (12)$$

When the above-mentioned formulas (8) through (12) are used for a simultaneous equation and the relation among the intake-air flow rate $\Delta Ga$, the engine speed $\Delta N$ and the load disturbance $\Delta Td$ is to be obtained, there is obtainable the following formula:

$$\Delta\dot{G}a^* = \left\{1 + \frac{\pi SNoJ}{30Kp}(1 + S\tau a)\right\}\Delta N^* + \frac{1 + S\tau a}{Kp}\Delta Td \quad (13)$$

where a dead time component due to the lag of controlling work is removed

From the above-mentioned formula (13), it is understood that even if the outer disturbance $\Delta Td$ is inserted in the engine, an air-flow rate $\Delta Ga^*$ expressed by:

$$\Delta\dot{G}a^* = \frac{1 + S\tau a}{Kp}\Delta Td \quad (14)$$

is to be supplied to the engine through the actuator in order that the fluctuation of the engine speed $\Delta N^*(\Delta N/No)$ is zero. Namely, it is necessary that the load disturbance $\Delta Td$ is detected and air is supplied to the engine at an amount corresponding to the sum of the value of the magnitude of the load disturbance $\Delta Td \times 1/Kp$ (a proportional constant) (the first item of the right side of the formula (14)) and the value of the differential of the outer disturbance ($Td \times \tau a/Kp$ (a proportional constant) (the second item of the right side of the formula (14)). This is clearly shown by a feedback system as shown in FIG. 1.

The inventors of this application have found that when the above-mentioned treatment is conducted to the idling engine speed control system, influence by the load disturbance $\Delta Td$ can be eliminated from the formula (13) in appearance, and the transfer characteristic from the air-flow rate for the engine to the revolution number of the engine can be irrelevant to the load disturbance $\Delta Td$.

As to elimination of the influence by the load disturbance, more detailed explanation will be made. Namely, the value corresponding to the air-flow rate is divided into two parts in a formula so that it is expressed by:

$$\Delta Ga^* = \Delta Gap^* + \Delta Gas^* \quad (15)$$

When the formula (14) is used for $\Delta Gas^*$, the formula (13) is expressed as follows in which the outer disturbance $\Delta Td$ can be effectively cancelled:

$$\Delta\dot{G}ap^* = \left\{1 + \frac{\pi SNoJ}{30Kp}(1 + S\tau a)\right\}\Delta N^* \quad (16)$$

Namely, the transfer function of the engine in which the dead time is removed by the following formula with the second-order-lag, is given by which the transfer function of the engine can be irrelevant to the load disturbance $\Delta Td$:

$$\frac{\Delta N^*}{\Delta\dot{G}ap^*} = \frac{1}{1 + \frac{\pi SNoJ}{30Kp}(1 + S\tau a)} \quad (17)$$

When separation of the air-flow rate as in the formula (15) is considered in a sense of physics, the first item of the right side in the formula (15) corresponds to the air-flow rate $\Delta\dot{G}ap^*$ which flows the first conduit which by-passes the throttle valve, and the second item of the right side corresponds to the air-flow rate $\Delta\dot{G}as^*$ which flows in the second conduit which by-passes the throttle valve. In fact, it is unnecessary to separate the flows, and it is sufficient to add the air-flow rate expressed by the second item to the air-flow rate flowing in the first conduit. In the formula (17), there is shown a transfer characteristic which is established between the air-flow rate $\Delta\dot{G}as^*$ flowing in the first conduit and the engine speed $\Delta N^*$.

Figure 2:
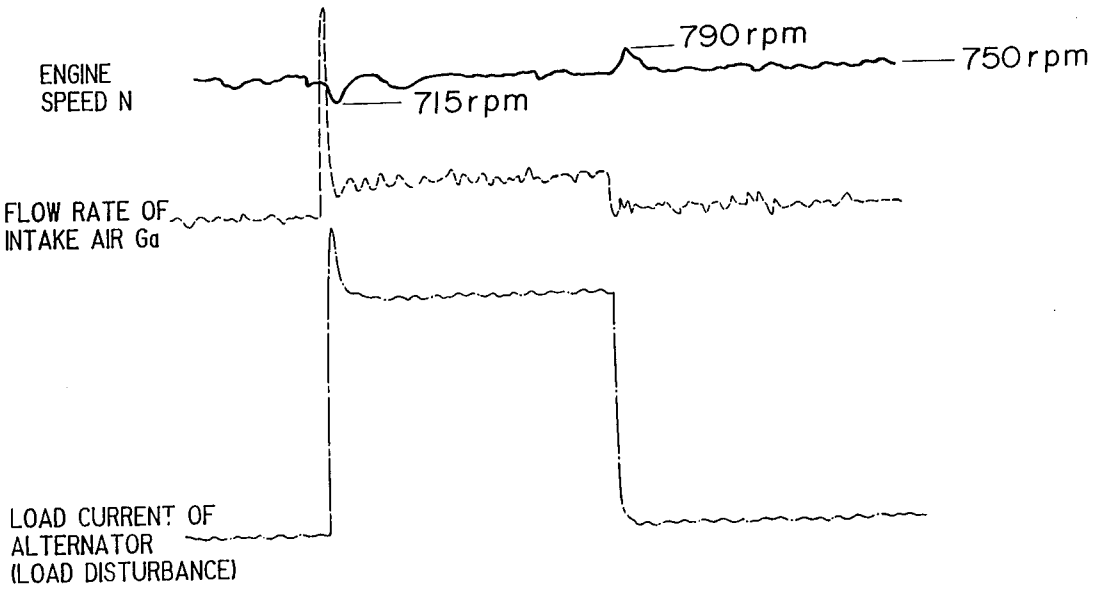
FIG. 2 is a diagram showing the result of experiments in which effect of the controlling apparatus of the present invention is illustrated.

FIG. 2 is a diagram showing a result of experiments conducted to confirm the above-mentioned effect. In FIG. 2, a broken line represents air-flow rate, a solid line represents engine speed, and one-dotted chain line represents a load current (load disturbance) in an alternator. In FIG. 2, the load disturbance is applied at the time point of ON, and it disappears at the time point of OFF. The load can be considered to be substantially a step outer disturbance although a rush current flows at these time points. In this case, the air-flow rate to be supplied is given by the following formula by conducting inverse transformation of the formula (14):

$$\Delta\dot{G}a = \frac{1}{Kp}\,u(t) + \frac{\tau a}{Kp}\,\delta(t) \tag{18}$$

Figure 12:
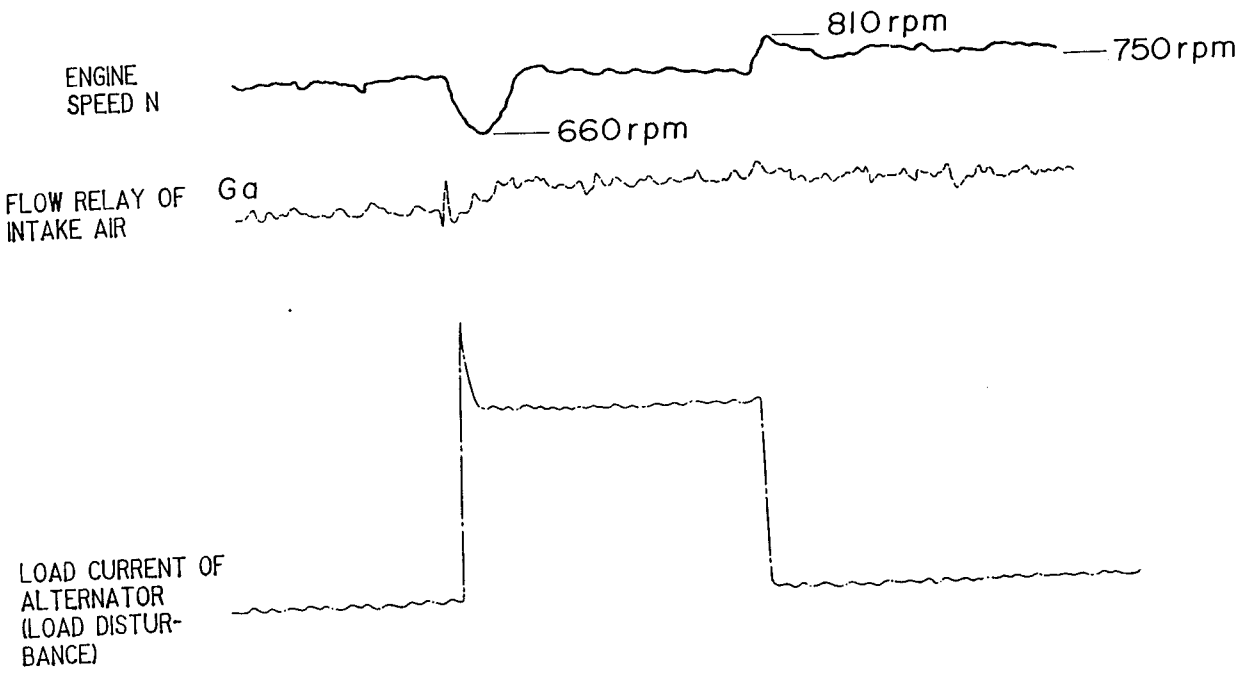
FIG. 12 is a diagram showing effect obtained by controlling a conventional idling engine speed controlling apparatus.

In the formula (18), it is understood that the air-flow rate is given by the sum of a unit step function u(t) and a delta function δ(t). Further, it is well understood that the broken line representing the air-flow rate in FIG. 2 shows a change very close to the change given by the Formula (18). On the other hand, as is clearly shown by the solid line in FIG. 2, decrease in the engine speed caused when a load is applied and increase in the engine speed when the load is removed are greatly reduced in comparison with those of the conventional case shown in FIG. 12 (an engine speed of 660 rpm at the time of insertion of a load, and an engine speed of 810 rpm at the time of removal of the load) although the engine speed in FIG. 2 is more or less changed due to disturbances (namely, a set engine speed of 750 rpm, an engine speed of 715 rpm at the time of insertion of a load, and an engine speed of 790 rpm at the time of removal of the load). The coefficients 1/Kp and τa/Kp which are respectively related to the load disturbance ΔTd and the differential component thereof depend on the performance of the engine and the volume Vm of the manifold, the displacement capacity Vh of the engine and the volumetric efficiency ηvo as shown in the formula (9). Accordingly, it is naturally that the coefficients should be changed depending on the performance of the engine. Thus, by changing the coefficients, good result is obtainable in the present invention even though there is fluctuation in critical point of performance of the engine.

As parameters representing working points of the engine, it is easy to use a parameter for torque VS. engine speed. Besides this, there are any or the combination of intake-air pressure VS. engine speed, graphically represented effective average pressure VS. engine speed, effective caloric value Q per cycle defined by the following formula VS. engine speed:

$$Q = \frac{1}{\mu - 1}\left[\int \mu P(\theta)dV(\theta) + \int V(\theta)dp(\theta)\right]$$

where μ is a specific heat ratio, P(θ) is cylinder pressure for each crank angle θ, and V(θ) is cylinder volume for each crank angle θ. In order to detect the load, the following ways can be considered. In a case of using an electric load, a load current in the alternator is detected by a magnetic field detecting element such as a hall element, a flux gate element and so on. In a case of using a mechanical load such as a power steering system, a power window system, four WS and so on, oil pressure is detected by a pressure sensor. Thus, in the above-mentioned embodiment of the present invention, feed-back compensation is given to an air-flow rate on the basis of the sum of the preduct of the magnitude of a load disturbance ΔTd and a proportional coefficient 1/Kp (the first item of the right side in the formula (14)) and the product of the differential component of the load disturbance ΔTd and a proportional coefficient Δa/Kp (the second item of the right side in the formula (14)), wherein the load disturbance being directly detected. Accordingly, the transfer characteristic from the response to the air-flow rate for the engine to the response of the engine speed can be irrelevant to the load disturbance ΔTd, with the consequence that influence by the load disturbance can be quickly removed so that the actual engine speed is quickly returned to a target speed.

In the above-mentioned embodiment, description has been made as to the case of application of the present invention to an electronically controlled fuel injection apparatus. However, the present invention is applicable to a carburatter or an electronically controlled carburatter to obtain the same effect as the above-mentioned embodiment.

In the present invention, the same function is obtainable by supplying to the engine an air-flow rate $\Delta\dot{G}a^*$ given by the above-mentioned formula (14) through an actuator even when a load torque disturbance other than the step-like load torque disturbance is applied to the engine.

Further, in the above-mentioned embodiment, the same effect can be obtained by using ignition timing as a manipulated variable in the same manner as the case using the air-flow rate.

A second embodiment of the idling engine speed controlling apparatus for an internal combustion engine according to the present invention will be described with reference to FIG. 3. In FIG. 3, the same reference numerals as in FIG. 1 designate the same or corresponding elements, and therefore, description of these elements is omitted.

In FIG. 3, an adder 13 is provided at the output end of the proportional and integral controller 2 to receive an output voltage signal from the controller 2. The adder 13 has an input terminal to which a transfer function 200 of a sub-feed-back system on intake-air pressure is added through a feed-back line 201 fed-back from the engine 4. A result of adding operations in the adder 13 is supplied to the actuator 3.

The feed-back line 201 extends between the adder 13 and the side of the intake-air pressure ΔPb/Pbo of the engine 4 to add the transfer function 200 of the sub-feed-back system to the adder 13.

An amount of the intake air $\Delta\dot{G}a/\dot{G}ao$ obtained by the actuator 3 is supplied to an input end of the subtractor 14. The other input end of the subtractor 14 receives the second-order-differential value $(1+S\tau\eta)$ of the engine speed. In the above-mentioned formula, S is jω and τη is a time constant. An output ΔE/Eo obtained in the subtracter 14 is added to the engine. The subtractor 14 may be constituted by a physical structure to satisfy the law of conservation of mass in the intake-air manifold.

In FIG. 3, $G_N(S)$, Gc(S) and Gb(S) are respectively transfer characteristics, i.e., Gλ(S) is fuel transfer characteristic, ΔN/No is engine speed and ΔTb is engine torque.

The operation of the second embodiment of the present invention will be described as to a case that sub-feed-back compensation on intake-air pressure is given to the output end of the proportional and integral controller 2, i.e. the intake air pressure is used as a state quantity.

A bracket indicated by a broken line in FIG. 3 represents the function of the engine in the block diagram, wherein a change $\Delta\dot{G}a$ of the intake-air flow rate is converted into a change ΔPb of intake-air tube pressure, and further converted into a change ΔN of engine speed. The feature of the second embodiment of the present invention is that the transfer function Sτa (where S is jω and τa is a time constant which is greater than a time constant $\tau\eta$) of the sub-feed-back system is added from the side of the intake air pressure $\Delta Pb/Pbo$ to the side of the intake-air flow rate $\Delta\dot{G}a/\dot{G}ao$, i.e. one input end of the subtracter 13 through the feed-back line 201, whereby the above-mentioned formula (4) representing the transfer characteristic of the engine in which the dead time is removed, can be replaced practically by a formula with the first-order-lag.

With respect to this point, detailed explanation will be made by using formulas.

The transfer characteristic $G_N(S)$ representing intake air quantity $\Delta E/Eo$ through the intake air pressure $\Delta Po/Pbo$ in FIG. 3 is given by the following formula with the first-order-lag, where $\tau\eta$ is zero for simplification:

$$G_N(S) = \frac{1}{1 + S\tau a} \tag{17}$$

In the formula (17), the time constant $\tau$ is expressed by the following formula:

$$\tau a = \frac{120}{\eta voNo} \cdot \frac{Vm}{Vh} \tag{18}$$

where $\eta vo$, No, Vm, Vh and $\tau a$ have the same values as in the formula (9).

The feed-back control for the engine speed before the above-mentioned transfer function $G_N(S)$, which is shown by the subtractor 14, is mechanically performed. When the engine speed is decreased in idling operations, intake-air pressure is increased and vise versa.

The transfer function Gc(S) is a transfer characteristic which is relied on air-metering system for fuel-controlling, wherein when fuel is injected in proportion to the intake-air pressure $\Delta Pb/Pbo$ (in Speed-Density D-jetro), it assumes a valve of 1 unless lag in controlling works is taken into consideration. On the other hand, when the fuel is injected in proportion to air-flow rate per number of revolution, which is obtained by measuring an amount of intake-air by using an air-flow meter (L-jetro), it assumes a value of $(1+S\tau a)$. For simplifying explanation, lets the transfer characteristic $Gc(S)=1$ here.

The fuel transfer characteristic $G\lambda(S)$ represents the characteristic of transferring the fuel in the air-intake tube, i.e. it relates the width of fuel injection pulse $\Delta Pw/Pwo$ for driving a fuel injection valve (not shown) with an air ratio $\Delta\lambda/\lambda o$. For simplifying explanation here, $G\lambda(S)$ is considered to be equal to 1.

The transfer characteristic Gb(S), which relates engine torque Tb with engine speed $\Delta N/No$, intake-air pressure $\Delta Pb/Pbo$, or air ratio $\Delta\lambda/\lambda o$, is given by the following formula (19):

$$\Delta Tb = Kn\frac{\Delta N}{No} + Kp\frac{\Delta Pb}{Pbo} + K\lambda\frac{\Delta\lambda}{\lambda o} \tag{19}$$

where Kn, Kp and $K\lambda$ are respectively constants which are experimentally determined at an equilibrium operating point (No, Pbo, $\lambda o$).

The meaning in physics of the constants and methods of measuring them are already described in the SAE Paper 860411 to obtain the engine torque $\Delta Tb$.

The engine torque $\Delta Tb$ is again converted into the engine speed $\Delta N/No$ by the well-known Euler's equation Namely, $$\frac{\Delta N}{No} = \frac{\pi/30}{SNoJ}\Delta Tb \tag{20}$$

where J is the moment of inertia of a flywheel.

The relation among the intake-air flow rate $\Delta\dot{G}a/\dot{G}ao$, the amount of intake-air $\Delta E/Eo$, and the revolution speed $\Delta N/No$ is given by the following formula (21), which is obtained by the law of conservation of mass, a state equation and the definition formula of volumetric efficiency:

$$\frac{\Delta\dot{G}a}{\dot{G}ao} - \frac{\Delta N}{No} = \frac{\Delta E}{Eo} = (1 + S\tau a)\frac{\Delta Pb}{Pbo} \tag{21}$$

When the above-mentioned formulas (17) through (21) are used for a simultaneous equation to obtain the relation of the amount of intake-air and the revolution speed $\Delta N$, there is obtainable the following formula (22):

$$\frac{\Delta N}{\Delta\dot{G}a} = \frac{No}{\dot{G}ao} - \frac{Kp}{Kp - Kn}\cdot\frac{1}{1 + bS + cS^2} \tag{22}$$

In the formula (20), dead time produced by lag of controlling works is removed.

$$b = \frac{\frac{\pi No\cdot J}{30} - Kn\cdot\tau a}{Kp - Kn} \tag{23}$$

$$c = \frac{\tau a\frac{\pi No\cdot J}{30} - Kp\cdot\tau a^2}{Kp - Kn} \tag{24}$$

Assuming that the transfer characteristic of the actuator 3 is 1 (this assumption is correct when an actuator having a quick response characteristic is used), the above-mentioned formula (22) correctly shows the transfer characteristic (the formula (4)) at present which is expressed by the two-order-lag (the two-order formula of S).

The inventors of this application have found that the transfer characteristic of the formula (4) with the second-order lag (the second-order formula of S) can be practically modified into a first-order-lag characteristic by providing a sub-feeding-back compensation system indicated by a reference numeral 101 in FIG. 3. The sub-feeding-back system 101 has a transfer function 100 ($S\tau a$) and is constituted by a sub-feeding-back line from the side of the intake-air pressure $\Delta Pb/Pbo$ to the side of the amount of intake-air $\Delta\dot{G}a/\dot{G}ao$. Thus, by providing the sub-feeding-back compensation system, the proportional gain and the integral gain of the proportional and integral controller 2 are made large and the sensitivity of the control system becomes high, whereby the transient characteristics of the control system can be remarkably improved.

With this respect, more detailed explanation will be made with reference to formulas. By providing the sub-feeding-back compensation system 101, an air-flow rate as expressed by the following formula is obtainable:

$$\frac{\Delta\dot{G}a}{\dot{G}ao} = \frac{\Delta\dot{G}ap}{\dot{G}ao} + S\tau a\frac{\Delta Pb}{Pbo} \tag{25}$$

In the formula (25), when it is assumed that the first item of the right side of the formula represents a flow rate of air flowing in the first conduit which by-passes the throttle valve, and the second item of the right side of the formula (25) represents a flow rate of air flowing in the second conduit which by-passes the throttle valve (in fact, it is unnecessary to make separate conduit and it is sufficient to give the flow rate expressed by the second item of the right side of the formula in addition to the flow rate in the first conduit), the following formula (26) is obtained by substituting the formula (25) for the formula (21):

$$\frac{\Delta \dot{G}ap}{Gao} = \frac{\Delta Pb}{Pbo} - \frac{\Delta N}{No} \tag{26}$$

In the same manner as obtaining the formula (22), the above-mentioned formula (26) is used for the formula (21) and the transfer characteristic from $\Delta\dot{G}a$ to $\Delta N$ so as to correspond to the formula (22) by the formulas (17) through (20). Then, the following formula (27) can be obtained:

$$\frac{\Delta N}{\Delta \dot{G}ap} = \frac{No}{Gao} \cdot \frac{Kp}{Kp - Kn} \cdot \frac{1}{1 + b^*S} \tag{27}$$

where $$b^* = \frac{\pi NoJ/30}{Kp - Kn} \tag{28}$$

In view of the formulas (22) and (27) for comparison, the transfer characteristic from $\Delta\dot{G}ap$ to $\Delta N$ is changed from the second-order lag to the first-order-lag. Accordingly, delay in phase is reduced if the same frequency is used, and a stable operation in the control system is obtainable even though the proportional gain and the integral gain are increased, this resulting in a quick response to torque disturbances.

In the following, improvement in performance obtained when the above-mentioned measures are taken will be described. For this purpose, explanation will be made by using a Nyquist diagram under assumption that a transfer characteristics $G_{345}(S)$ inclusive of the actuator 3 through the engine 4 is of the first-order-lag.

When $$G_{345}(S) = \frac{1}{1 + ST}$$

there is obtainable:

$$Gc(S)G_{345}(S) = \frac{1 + KTi}{STi} \cdot \frac{1}{1 + ST} \tag{29}$$

When the Nyquist diagram of the formula (2) is drawn by using the formula (29) (for comparison, values are determined as follows: regulated dead time $Ln = L/T = 0.5$, regulated integrated time $Tn = Ti/T = 1$, the first-order-lag time constant $T = 0.3$ sec and proportional gain $K = 1$), there is obtainable FIG. 4.

Figure 4:
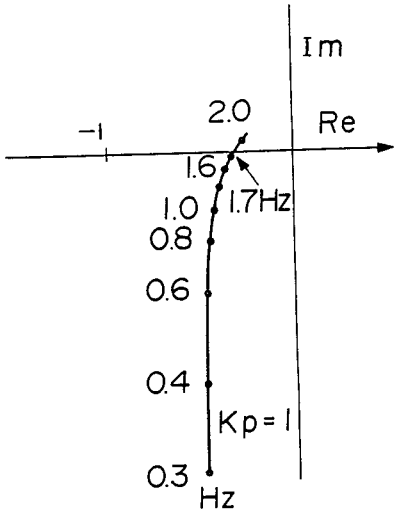
FIG. 4 is a Nyquist diagram for analysis of stableness by using a characteristic formula for the control system of the present invention.
Figure 15:
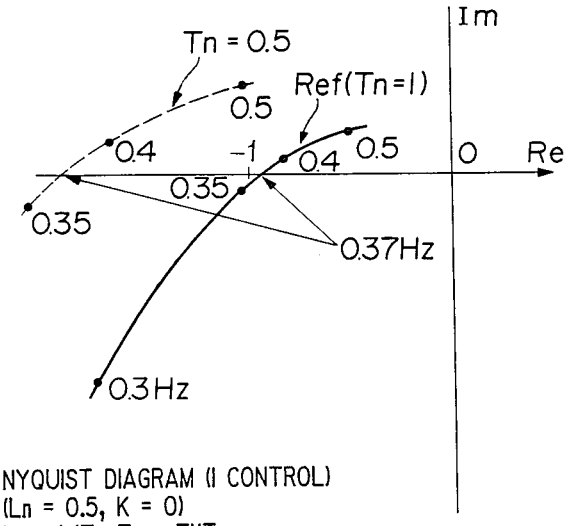
FIG. 15 is a Nyquist diagram for the conventional controlling apparatus.
Figure 16:
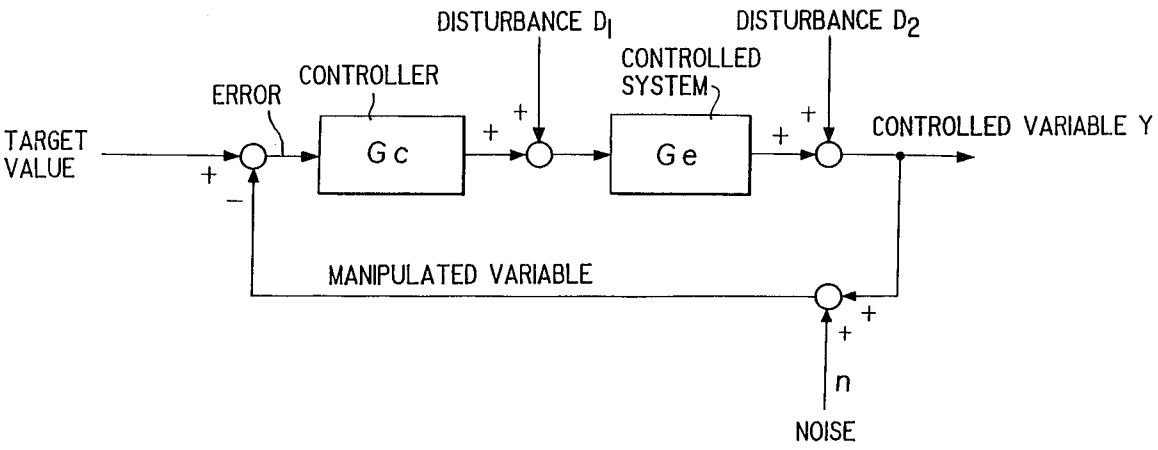
FIG. 16 is a block diagram for illustrating change of transfer functions by load disturbances to the control system shown in FIG. 13; and, FIG. 17 is a block diagram showing another conventional engine speed controlling in apparatus.
Figure 17:
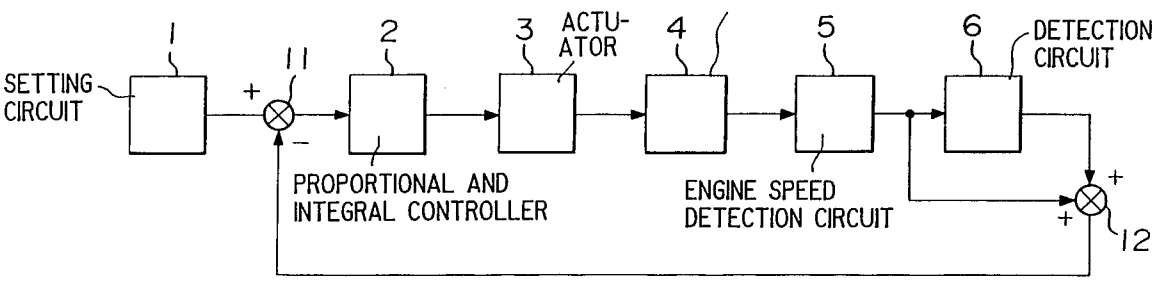

In comparing FIG. 4 with FIG. 15, it becomes clear that the frequency at the point of the intersection with solid line indicates 1.7 Hz and the absolute value in this point is 0.3 (it has a gain margin of 20 dB) in FIG. 4, whereas the gain margin is 0.4 dB in the reference condition in FIG. 15. Accordingly, stability is improved and response characteristic is four times as fast as the conventional control system. Thus, it is possible to improve both the stability and the response by providing the sub-feeding-back compensation with the transfer function 100 ($S\tau a$) with respect to intake-air pressure $\Delta Pb$ as a state quantity.

The above-mentioned effect will be described from the viewpoint of physics. When a load is suddenly applied to the engine under steady condition, the engine speed is naturally reduced ($\Delta N \leqq 0$). In this case, the engine is so operated that the intake-air pressure is increased by a mechanical feeding-back system even though there is no sub-feed-back compensation of the intake-air pressure $\Delta Pb$. In other wards, when $\Delta\dot{G}a = 0$ and if $\Delta N \leqq 0$ in the formula (21), then, $\Delta Pb \geqq 0$.

Since the operation obtained by the mechanical feed-back system, however, is slow, the stability and the response of the feed-back system are poor.

The sub-feed-back of the intake-air pressure $\Delta Pb$ provided by the present invention functions to reinforce the mechanical feed-back compensation. Namely, in the formula (21), when the condition of $\Delta N \leqq 0$ and $\Delta Pb \geqq 0$ is given, the sub-feed-back of the intake-air pressure $\Delta Pb$ as a state quantity functions to feed additionally an amount of the intake-air $\Delta\dot{G}a$ in proportion to the differential component of the intake-air pressure $\Delta Pb$, whereby a quick rise in the intake-air pressure is obtainable owing to the additionally fed intake-air. In other words, the sub-feed-back of the intake-air pressure $\Delta Pb$ naturally reinforces the mechanical feed-back.

As is well known, an intake-air pressure is a state quantity corresponding to a torque produced by the engine. Accordingly, it is apparent that the same effect can be obtained by giving sub-feed-back compensation in proportion to the differential of torque T, graphically represented effective average pressure Pi or an amount of calory Q per cycle which is defined by the following formula, instead of the intake-air pressure:

$$Q = \frac{1}{\mu - 1}\left[\mu \int p(\theta)dv(\theta) + \int v(\theta)dp(\theta)\right]$$

where $\mu$ is a specific heat ratio, $P(\theta)$ is cylinder pressure at a crank angle $\theta$, $V(\theta)$ is cylinder volume at an crank angle $\theta$ in which the crank angle $\theta$ refers to time periods of compression, combustion and expansion process.

A proportional coefficient $\tau a$ used when the sub-feed-back compensation in proportion to the differential component of the intake-air pressure as a state quantity is carried out, is in inverse proportion to the volumetric efficiency and the engine speed and in proportion to the ratio of the volume of manifold Vm to the volume of displacement of the engine Vh, as understood from the formula (18). Accordingly, when the value of the proportional coefficient is changed depending on the above-mentioned values, the same function as mentioned above can be obtained at various operating points of the engine.

In the above-mentioned construction of the present invention, if the intake-air pressure or another state quantity can not be measured, it is naturally impossible to obtain the sub-feed-back compensation. However, the same effect as the above-mentioned sub-feed-back compensation can be obtained by taking measures as follows.

Namely, when the formula (26) is put into the formula (25), the following formula is obtainable:

$$\frac{\Delta Ga}{Gao} = (1 + S\tau a)\frac{\Delta Gap}{Gao} - S\tau a\frac{\Delta N}{No} \tag{30}$$

When the time constant $\tau\eta$ which was neglected for simplification in the description of FIG. 3 is taken into consideration, the following strict formula is led:

$$\frac{\Delta Ga}{Gao} = (1 + S\tau a)\frac{\Delta Gap}{Gao} - S\tau a(1 + S\tau\eta)\frac{\Delta N}{No} \quad (31)$$

Figure 5:
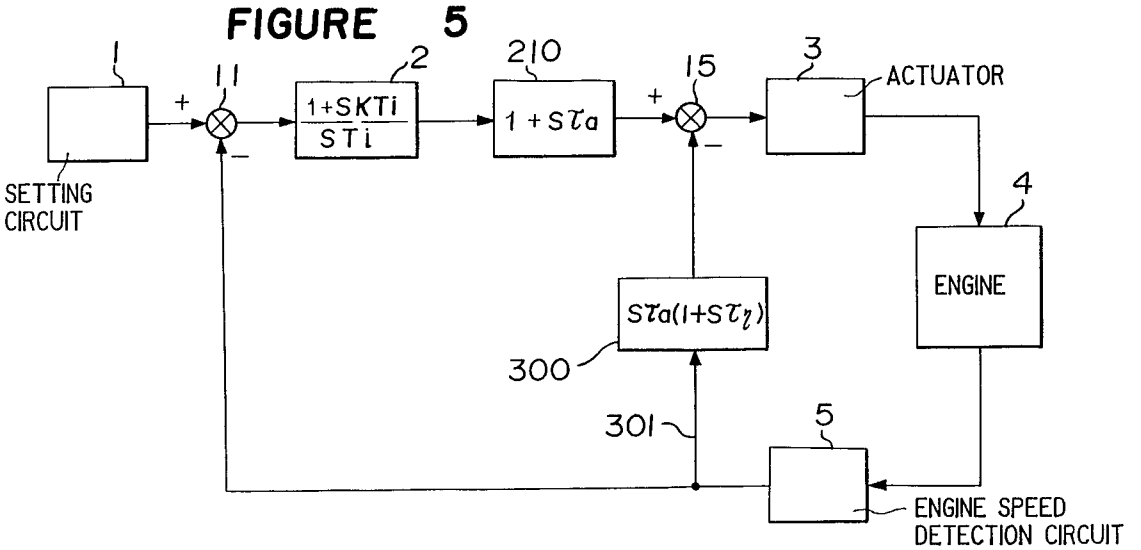
FIG. 5 is a block diagram of a modification of the second embodiment of the present invention.

FIG. 5 is a block diagram showing a modified embodiment of the second embodiment of the present invention to which the formula (31) is applicable. The embodiment shown in FIG. 5 provides the same effect as that having the sub-feed-back system in proportion to the differential of the intake-air pressure as a state quantity. This is because intake-air pressure is obtained by the formula (26) when such sub-feed-back system is used.

The embodiment as in FIG. 5 in accordance with the formula (31) will be described.

In FIG. 5, in addition to the output of the proportional and integral controller 2, a first-order-advance compensating transfer function 210 ($1+S\tau a$) is added to an input end of a subtractor 15, which has the other input end to receive the output of the engine speed detection circuit 5 with a engine speed feed-back compensating transfer function 300 ($\{S\tau a(1+ST\eta)\}$) through a compensation system 301. The output of the subtractor 15 is to add the actuator 3.

Namely, in FIG. 5, the first-order-advance compensating transfer function 210 ($1+S\tau a$) of the output of the proportional and integral controller 2 corresponds to the first item of the right side of the formula (31). On the other hand, $S\tau a(1+ST\eta)\Delta N/No$ which is in proportion to the first order and the second order differential components of the engine speed and which is the engine speed feed-back compensating transfer function 300 of the output of the engine speed detection circuit 5 constitute the second item of the right side of the formula (31). The both input signals are subjected to subtracting operation in the subtractor 15, and the output of the subtractor 15 is supplied to the actuator 3.

Thus, even when the intake-air pressure or another state quantity for the intake-air pressure can not be detected, the engine speed feed-back compensation which is in proportion to the first-order and the second order differential of the engine speed is added to the first-order-advance-compensation of the intake-air flow rate. In this case, the time constants $\tau a$, $\tau\eta$ on each of the differential components relys on the operating point of the engine. Accordingly, by changing the constants depending on the operating points of the engine, effect of the present invention can be obtained at every operating point.

Thus, in the second embodiment of the present invention, the sub-feed-back system is provided in proportion to the differential of the intake-air pressure with respect to the flow rate of the intake-air. Alternatively, the first-order and the second order differential components of operational parameters such as the engine speed are added to the first-order-advance signal component. Accordingly, the second-order-lag in the engine characteristics can be practically modified to be the first-order-lag, whereby delay in phase in the control system can be remarkably reduced. Further, the proportional gain and the integral gain of the proportional and integral controller can be increased, and the sensitivity of the control system is improved, so that fluctuation of the engine speed due to load disturbances can be quickly regulated.

A third embodiment of the engine speed controlling apparatus according to the present invention will be described.

Figure 6:
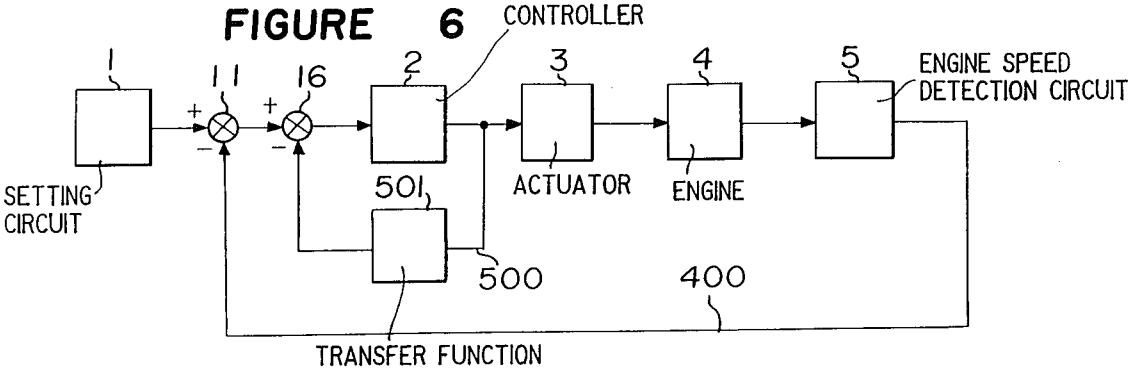
FIG. 6 is a block diagram showing the construction of a third embodiment of the present invention.

FIG. 6 is a block diagram of the third embodiment of the present invention. The third embodiment as shown in FIG. 6 is provided with a sub-feed-back loop 500 in addition to a main feed-back loop 400 which is the same as that shown in FIG. 13. With the sub-feed-back loop 500, a set signal corresponding to a target engine speed outputted from the setting circuit 1 is added to the first subtractor 11, and a detection signal depending on an actual engine speed which is outputted to the engine speed detection circuit 5 is also added to the subtractor 11 through the main feed-back loop 400.

The subtractor 11 compares the set signal with the detection signal to generate an error signal, and the error signal is supplied to a second subtractor 16. The second subtractor 16 also receives an output signal from the proportional and integral controller 2, through the sub-feed-back loop 500 with a transfer function 501.

The feature of the third embodiment of the present invention is that dead time, which is a cause of hindering improvement of the sensitivity in the control system, is removed from the main feed-back loop 400 for controlling the engine speed by relating the transfer function 501 in the sub-feed-back loop 500 with the transfer function of the output of the proportional and integral controller 2 through the output of engine speed.

The way of removing the dead time will be described in more detail.

Figure 13:
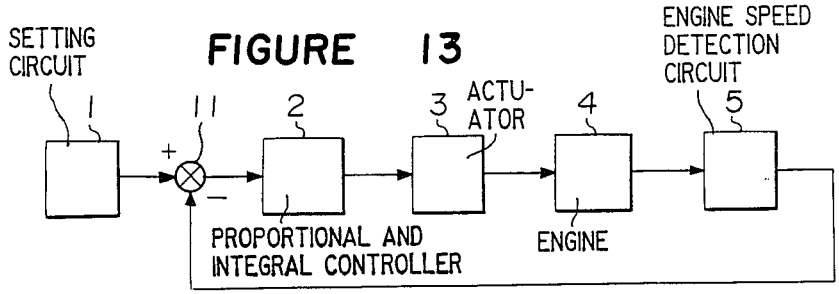
FIG. 13 is a block diagram showing the construction of a conventional engine speed controlling apparatus.
Figure 14:
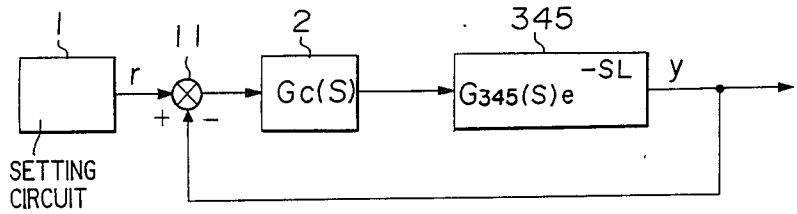
FIG. 14 is a block diagram showing the function of the conventional controlling apparatus shown in FIG. 13.

In the same manner as that described with reference to FIG. 13, when the transfer functions of the output to the actuator 3 through the output of the detection circuit 5 are gathered into a single transfer function 345, an engine speed controlling system with the transfer function 345 is as in FIG. 7.

Figure 7:
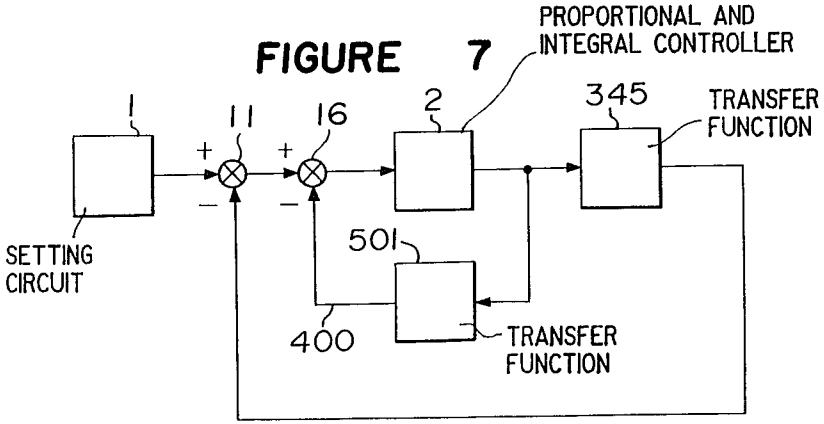
FIG. 7 is a block diagram showing for simplification the block diagram of FIG. 6 in which effect of the third embodiment is illustrated.

In FIG. 7, the sub-feed-back loop 500 is formed between the input and output terminals of the proportional and integral controller 2. When $G_{345}(S)$-$G_{345}(S)e^{-SL}$ is selected for the transfer function 501, the transfer characteristic to transform a voltage signal r to a voltage signal y is expressed by:

$$\frac{y}{r} = \frac{Gc(S)G_{345}(S)}{1 + Gc(S)G_{345}(S)} e^{-SL} \quad (32)$$

Accordingly, the characteristic equation is:

$$1+Gc(S)G_{345}(S)=0 \quad (33)$$

Thus, the item of dead time $e^{-SL}$, which renders the control system to be unstable, can be removed from the characteristic equation Accordingly, it is possible to increase the proportional gain and the integral gain of the controller 2 to thereby improve the sensitivity of the control system. Therefore, if the engine speed is reduced by load disturbances, it is quickly returned to the target engine speed.

Figure 8:
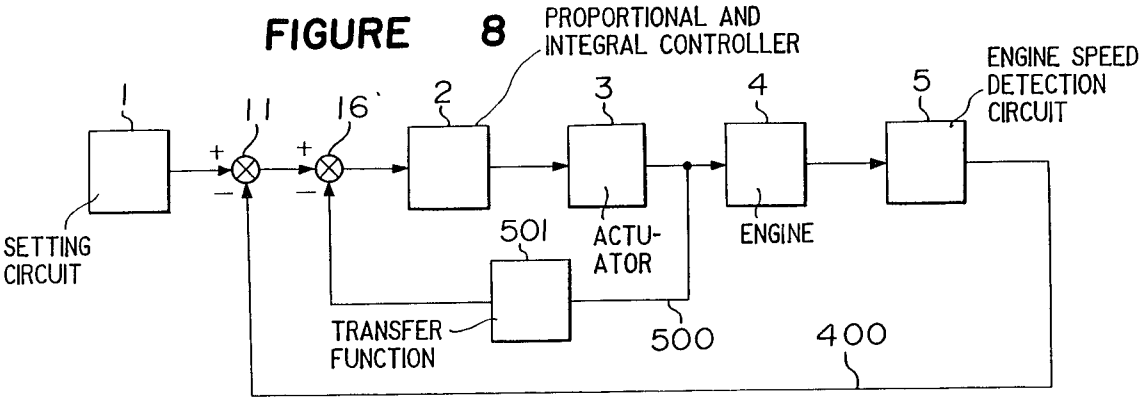
FIG. 8 is a diagram showing the construction of a fourth embodiment of the present invention.

FIG. 8 is a block diagram of a fourth embodiment of the engine speed controlling apparatus according to the present invention. In the fourth embodiment, the sub-feed-back loop 500 is formed between the output end of the actuator 3 and the input end of the proportional and integral controller 2. In this case, the transfer function 501 is selected to be:

$$G20(S)=G45(S)-G45(S)e^{-SL} \quad (34)$$

where $G45(S)e^{-SL}$ is a transfer function of the output of the actuator 3 through the output of the engine speed detection circuit 5. G45(S) is a component obtained by removing the item of dead time $e^{-SL}$ from the above-mentioned transfer function.

Figure 9:
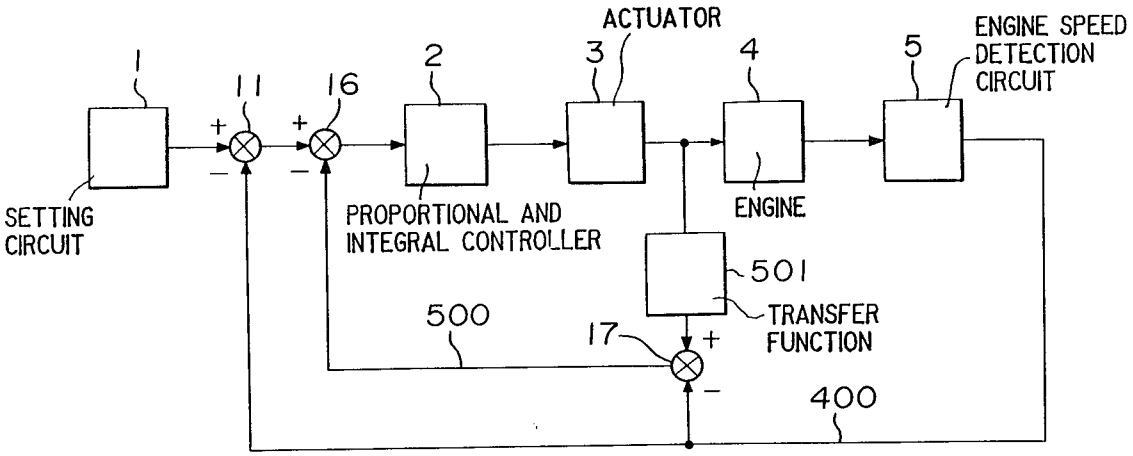
FIG. 9 is a block diagram showing the construction of a fifth embodiment of the present invention.

FIG. 9 is a block diagram of a fifth embodiment of the present invention which is a modification of the fourth embodiment shown in FIG. 8. In FIG. 9, a part of a voltage signal which is outputted from the engine speed detection circuit 5 and is fed-back through the main feed-back loop 400 is added to a third subtractor 17. The subtractor 17 is adapted to receive a voltage signal with the transfer function 501 inserted in the sub-feed-back loop 500. An error signal obtained by subtracting both signals in the subtractor 17 is added to the second subtractor 16 through the sub-feed-back loop 500.

In FIG. 9, it is noted that the transfer function $G45(S)e^{-SL}$ is the output of the engine speed detection circuit 5. Accordingly, when the transfer function 501 is selected to be G20(S)=G45(S), the construction of the apparatus in FIG. 9 is equivalent to that in FIG. 8.

Thus, in the fourth and the fifth embodiments, the sub-feed-back loop is formed between the input and output terminals between the proportional and integral controller, or between the input of the proportional and integral controller and the output of the actuator, in which a transfer function related to the transfer function of the engine is given in the sub-feed-back loop. Accordingly, adverse effect by the dead time which is included in the main feed-back loop can be removed, and the proportional gain and the integral gain of the proportional and integral controller can be improved, whereby the sensitivity of the control system is improved and fluctuation of the engine speed due to the load disturbances can be quickly regulated.

Figure 10:
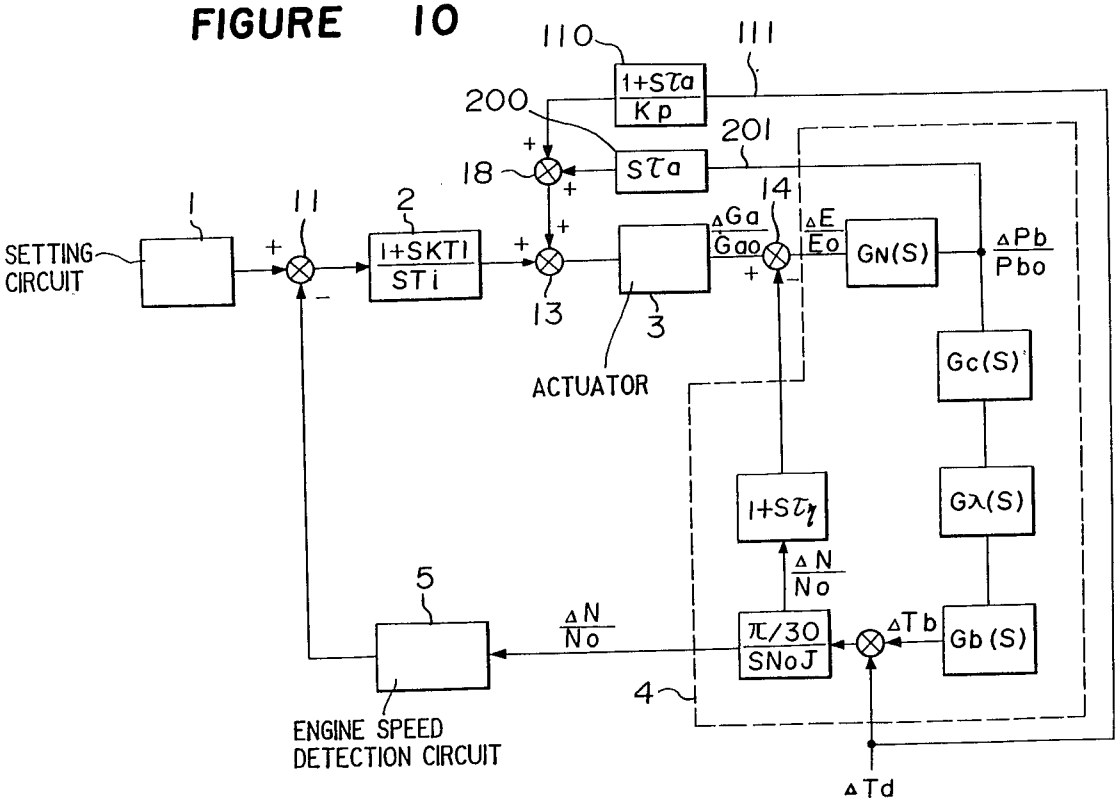
FIG. 10 is a block diagram showing the construction of a sixth embodiment of the present invention.

FIG. 10 is a sixth embodiment of the engine speed controlling apparatus according to the present invention. In FIG. 10, the same reference numerals as in FIG. 1 designate the same or corresponding parts. The construction of the sixth embodiment is the same as that of the first embodiment except that it is further provided with the feed-back control system 201 with the transfer function 200 (which is described with reference to the second embodiment shown in FIG. 3), wherein a signal passing through the feed-back system 111 with the transfer function 110 and a signal passing through the feed-back system 201 with the transfer function 200 are added to an adder 18, and thus obtained signal in the adder 18 is added to the input end of the adder 13.

In the sixth embodiment, feed-back compensation 110 in proportion to the magnitude of outer disturbances and the differential of them, and feed-back compensation 200 in proportion to the differential of the intake-air pressure ΔPb/Pbo are given. Accordingly, fluctuation of the engine speed cause by the disturbances can be controlled as the effect obtained by the feed-back compensation system 110, and the transfer characteristic of the engine (expressed by the second-order-lag plus dead time) can be modified by the first-order-lag plus dead time (effect by the feed-back compensation system 200). Thus, the proportional gain and the integral gain of the controller 2 can be made greater.

Figure 11:
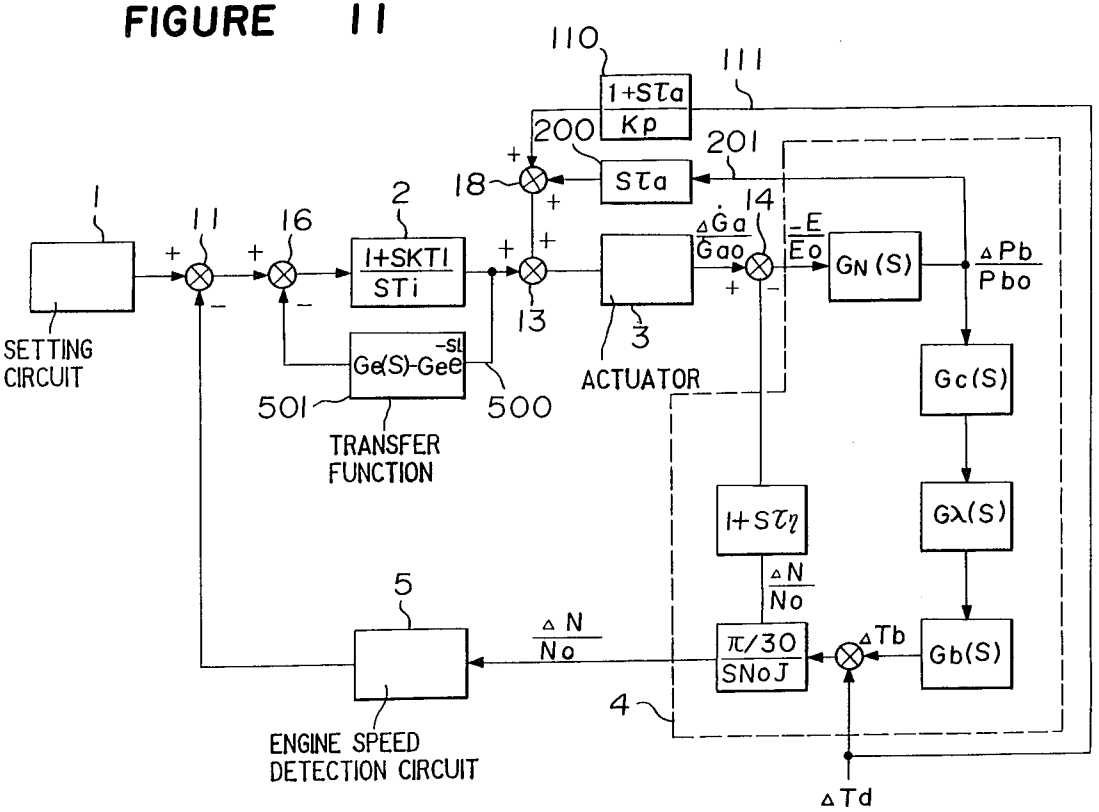
FIG. 11 is a block diagram showing the construction of a seventh embodiment of the present invention.

FIG. 11 shows a seventh embodiment of the present invention. The construction of the seventh embodiment is the same as that of the above-mentioned sixth embodiment except that it is further provided with the sub-feed-back loop 500 used in the third embodiment as shown in FIG. 6. In FIG. 11, the output of the proportional and integral controller 2 is applied to the second subtractor 16 through the sub-feed-back loop 500 with the transfer function 501. The seventh embodiment is to compensate the dead time and to increase the proportional gain and the integral gain of the controller 2. In the seventh embodiment, Ge(S) (or $G_{345}(S)$) of the transfer function $(Ge(S)\text{-}Ge(S)\times e^{-SL})$ is given by the following equation with the first-order-lag:

$$Ge(S) = \frac{1}{1 + ST} \qquad T = \frac{\pi No/30}{Kp - Kn}$$

We claim:

1. An idling engine speed controlling apparatus for an internal combustion engine comprising:

an intake air conduit formed to by-pass a throttle value, an actuator for controlling air flowing in said intake air conduit and a detecting means for detecting an idling speed of said engine to thereby control by feeding back the idling speed to be a predetermined value, said idling engine speed controlling apparatus being characterized by comprising means for detecting a torque disturbance to said engine to convert it into an electric signal depending on the magnitude of the disturbance, and a control means for controlling a parameter of the engine selected from the group of air-flow rate or ignition timing in response to a signal wherein said signal is in proportion to the sum of said electric signal and a time-differential component of said electric signal.

2. The idling engine speed controlling apparatus according to claim 1, wherein said air-flow rate and said ignition timing is controlled by a value of the product of a proportional coefficient ($K_1$) and the magnitude of said electric signal plus the product of a proportional coefficient ($K_2$) and the differentiation of the magnitude of said electric signal.

3. The idling engine speed controlling apparatus according to claim 2, wherein said proportional coefficients ($K_1$, $K_2$) are changed depending on changes of performance parameters for said engine.

4. The idling engine speed controlling apparatus according to claim 3, wherein said performance parameters are selected from the group consisting of intake-air pressure, engine speed intake-air flow rate, torque and a graphycally represented effective average pressure.

5. The idling engine speed controlling apparatus according to claim 2, wherein said proportional coefficients ($K_1$, $K_2$) are respectively:

$$K_1 = 1/K_p \text{ and } K_2 = \tau a/K_p$$

where, $$\tau_a = \frac{120}{\eta voNo}\left(\frac{Vm}{Vs}\right)$$

(where Vm is a volume defined by a throttle valve, the inner wall of said intake air conduit and an air-intake valve for said engine, Vs is a displacement capacity and ηvo is efficiency per volume at an equilibrium intake-air pressure Pbo and a balanced revolution No.

6. An idling engine speed controlling apparatus for an internal combustion engine which comprises:

an engine speed detecting circuit for detecting an idling speed of said engine, a setting speed circuit for outputting a set signal corresponding to a target speed on said engine, a proportional and integral controller for amplifying and integrating an error produced between a signal detected by said engine speed detecting circuit and said set signal, a feed-back control system which gives sub-feed-back compensation to the output end of said proportional and integral controller so that an amount of air flowing in an intake air conduit by-passing a throttle value is compensated with the first-order-lag component caused by the change of a state quantity which represents the condition of said engine, or which controls said amount of air in response to a component selected from the group of the first-order-lag component, the second-order-lag component caused by the change of an operational parameter of said engine, or the sum of or the difference between these components, and an actuator for controlling an air-flow rate in said intake air conduit by the output of said proportional and integral controller to thereby coincide the idling speed with the target speed.

7. The idling engine speed controlling apparatus according to claim 6, wherein as said state quantity for said engine, one of the parameters selected from the group of the intake air pressure Pb, torque T a graphically represented effective range pressure Pi, or calory Q per cycle is used.

8. The idling engine speed controlling apparatus according to claim 6, wherein said operational parameter is selected from, said air-flow rate or said engine speed.

9. The idling engine speed controlling apparatus according to claim 6, wherein a coefficient $K_0$ for the first-order-lag component given by the change of the state quantity, and coefficients $K_1$ and $K_2$ for the second-order-lag component given by the change of the operational parameter of said engine, are respectively changed depending on the change of operational parameters of said engine.

10. The idling engine speed controlling apparatus according to claim 6, wherein said sub-feed-back compensation is given by:

$$\frac{\Delta \dot{G}a}{\dot{G}a0} = S\tau a \cdot \frac{\text{Change in state quantity}}{\text{Equilibrium value in state quantity}}$$

where $\Delta\dot{G}a$ is a change of a flow rate of intake air, $\dot{G}ao$ is a flow rate of intake air flowing through a throttle valve and in the intake air conduit at an equilibrium time, S is $j\omega$, and $\tau a$ is a time constant.

11. The idling engine speed controlling apparatus according to claim 6, wherein control in response to the first-order-lag component, or the second-order-lag component given by the change of the operational parameter, or the sum of or the difference between these elements follows:

$$\frac{\Delta \dot{G}a}{\dot{G}ao} = (1 + S \cdot \tau a)\frac{\Delta \dot{G}ap}{\dot{G}ao} - S\tau a \frac{\Delta N}{No}$$

where $\tau a$ is $$\frac{120}{\eta voNo}(Vm/Vs)$$

Vm is a volume defined by said throttle valve, the inner wall of said intake air conduit and an air intake valve for said engine, Vs is a displacement capacity, $\eta vo$ is efficiency per volume at an equilibrium intake air pressure and at an equilibrium revolution speed No, Pb is intake air pressure, N is revolution number, $\tau\eta$ is a time constant smaller than $\tau a$, affixed symbol o indicates values at an equilibrium time, $\dot{G}ao$ is an air-flow rate of intake air at an equilibrium time which flows through a throttle valve and in a by-pass air conduit, and S is $j\omega$.

12. An idling engine speed controlling apparatus which is so adapted to detect an engine speed by a detection circuit to output an error signal on the basis of the engine speed, to compare the error signal with a set signal in response to a target speed by means of a main feed-back loop to thereby output an error signal, to feed the error signal to a proportional and integral controller, and to drive an actuator by the output of the controller to cancel the error signal whereby the engine speed is controlled to be at the target speed, said idling engine speed controlling apparatus being characterized by comprising a sub-feed-back loop in which an output from said proportional and integral controller or an output from said actuator is fed back to the input side of said controller so as to include a transfer function of said actuator through said detection circuit.

13. The idling engine speed controlling apparatus according to claim 12, wherein the transfer function of said sub-feed-back loop is $G(S)\text{-}G(S)_e{}^{-SL}$ when a transfer function for said actuator through said detection circuit is given by $e^{-SL}G(S)$, where L is dead time and G(S) is a rational expression of S.

14. The idling engine speed controlling apparatus according to claim 12, wherein the difference between a signal value of the engine speed and the product of the output value of said controller and G(S) is fed back to the input end of said controller.

15. The idling engine speed controlling apparatus according to claim 1, which comprises a feed-back control system for giving sub-feed-back compensation to the output end of said proportional and integral controller so that an amount of air flowing in an intake air conduit by-passing a throttle valve is compensated with the first-order-lag component given by the change of a state quantity which represents the condition of said engine.

16. The idling engine speed controlling apparatus according to claim 1, wherein a feed-back control system for giving sub-feed-back compensation to the output end of said proportional and integral controller so that an amount of air flowing in an intake air conduit by-passing a throttle valve is compensated with the first-order-lag component given by the change of a state quantity which represents the condition of said engine, and a sub-feed-back loop in which an output from said proportional and integral controller or an output from said actuator is fed back to the input side of said controller so as to include a transfer function for said actuator through said detection circuit.

* * * * *